US008205684B2

(12) United States Patent
Kokinelis et al.

(10) Patent No.: US 8,205,684 B2
(45) Date of Patent: Jun. 26, 2012

(54) STRUCTURAL SUPPORT FOR POWER TOOL HOUSINGS

(75) Inventors: Christopher Anthony Kokinelis, Flemington, NJ (US); Warren Andrew Seith, Bethlehem, PA (US)

(73) Assignee: Ingersoll-Rand Company, Piscataway, NJ (US)

( * ) Notice: Subject to any disclaimer, the term of this patent is extended or adjusted under 35 U.S.C. 154(b) by 161 days.

(21) Appl. No.: 11/755,260

(22) Filed: May 30, 2007

(65) Prior Publication Data

US 2008/0000665 A1 Jan. 3, 2008

Related U.S. Application Data

(60) Provisional application No. 60/809,954, filed on May 31, 2006.

(51) Int. Cl.
*B25F 5/02* (2006.01)

(52) U.S. Cl. ..... 173/171; 173/162.2; 227/130; 227/156; 310/47; 310/50

(58) Field of Classification Search ..... 173/171, 173/162.2, 162.1, 170; 227/130, 156; 310/47, 310/50; 403/220, 247, 286, 341
See application file for complete search history.

(56) References Cited

U.S. PATENT DOCUMENTS

| | | | | | |
|---|---|---|---|---|---|
| 3,413,498 | A | * | 11/1968 | Bowen, III et al. | 310/47 |
| 3,710,154 | A | * | 1/1973 | Schilling | 310/50 |
| 3,908,139 | A | * | 9/1975 | Duncan, Jr. | 310/50 |
| 4,081,704 | A | * | 3/1978 | Vassos et al. | 310/50 |
| 4,133,971 | A | | 1/1979 | Wilton et al. | |
| 4,144,738 | A | * | 3/1979 | Dziura et al. | 72/409.08 |
| 4,157,751 | A | * | 6/1979 | Grundken et al. | 198/735.2 |
| 5,136,921 | A | * | 8/1992 | Buchel | 89/1.14 |
| 5,372,420 | A | * | 12/1994 | Van Deursen et al. | 366/129 |
| 5,419,659 | A | * | 5/1995 | Mercer | 405/302.7 |
| 5,531,538 | A | * | 7/1996 | Stolzer | 403/374.4 |
| 5,565,719 | A | * | 10/1996 | Kuhlmann | 310/47 |
| 5,692,574 | A | * | 12/1997 | Terada | 173/162.2 |

(Continued)

FOREIGN PATENT DOCUMENTS

DE 85 05 814 5/1985

(Continued)

OTHER PUBLICATIONS

Partial European Search Report for EP12154256 dated Mar. 22, 2012.

(Continued)

*Primary Examiner* — Brian D Nash
*Assistant Examiner* — Michelle Lopez
(74) *Attorney, Agent, or Firm* — RatnerPrestia

(57) ABSTRACT

A pistol and/or clam shell style power tool housing. With respect to the pistol style housing, the tool housing includes a body defining a head portion with a handle portion depending therefrom to define a forward and/or a rear junction. A metal reinforcing member is configured to span along an inside surface of the body from the head portion to the handle portion such that the reinforcing member bridges either the forward or rear junction. In at least one embodiment, the reinforcing member is provided along each lateral side of the tool body. With respect to the clam shell style housing, with two opposed body halves interconnected to define the tool housing body, at least one continuous reinforcing ring is positioned about both halves of the tool housing body to prevent splitting between the two halves.

10 Claims, 4 Drawing Sheets

U.S. PATENT DOCUMENTS

| | | | | |
|---|---|---|---|---|
| 6,176,412 | B1 * | 1/2001 | Weinger et al. | 227/142 |
| 6,318,216 | B1 * | 11/2001 | Eggert et al. | 81/61 |
| 6,345,927 | B1 * | 2/2002 | Pao et al. | 403/294 |
| 6,568,483 | B2 * | 5/2003 | McCallops et al. | 173/169 |
| 6,962,211 | B2 * | 11/2005 | Daubner et al. | 173/162.2 |
| 7,090,032 | B2 * | 8/2006 | Wada et al. | 173/217 |
| 7,100,706 | B2 * | 9/2006 | Meixner et al. | 173/162.2 |
| 7,197,961 | B2 * | 4/2007 | Kageler et al. | 81/52 |
| 7,252,156 | B2 * | 8/2007 | Sugiyama et al. | 173/162.1 |
| 7,637,328 | B2 * | 12/2009 | Sato | 173/162.2 |
| 2002/0011136 | A1 * | 1/2002 | Eggert et al. | 81/125.1 |
| 2003/0015066 | A1 | 1/2003 | Chao | |
| 2003/0094293 | A1 | 5/2003 | Fuchs | |
| 2004/0011544 | A1 * | 1/2004 | Cooper et al. | 173/217 |
| 2004/0154813 | A1 * | 8/2004 | Daubner et al. | 173/162.2 |
| 2004/0188119 | A1 * | 9/2004 | Chen | 173/217 |
| 2006/0037766 | A1 | 2/2006 | Gass et al. | |
| 2007/0044984 | A1 * | 3/2007 | Fischer et al. | 173/217 |
| 2007/0256914 | A1 | 11/2007 | Lohr et al. | |
| 2007/0289763 | A1 * | 12/2007 | Wiker et al. | 173/162.2 |
| 2008/0000664 | A1 * | 1/2008 | Steinke | 173/162.2 |
| 2008/0041603 | A1 * | 2/2008 | Wiker et al. | 173/162.1 |
| 2009/0120658 | A1 * | 5/2009 | Kuhnle et al. | 173/211 |
| 2009/0218114 | A1 * | 9/2009 | Ohlendorf et al. | 173/211 |
| 2010/0012339 | A1 * | 1/2010 | Hahn et al. | 173/162.2 |

FOREIGN PATENT DOCUMENTS

| | | | |
|---|---|---|---|
| DE | 4204947 | A1 | 8/1993 |
| DE | 198 05 577 | A1 | 9/1998 |
| DE | 10 2004 051913 | | 2/2006 |
| EP | 0 698 449 | A2 | 2/1996 |
| EP | 1 099 517 | A2 | 5/2001 |
| EP | 1 132 178 | A1 | 9/2001 |
| WO | WO 2005/039829 | A1 | 5/2005 |

OTHER PUBLICATIONS

European Search Report for Application No. 12154260.9 mailed Mar. 27, 2012.

European Search Report for Application No. 12154262.5 mailed Mar. 27, 2012.

European Search Report for Application No. 12154256.7 mailed Mar. 22, 2012.

* cited by examiner

STRUCTURAL SUPPORT FOR POWER TOOL HOUSINGS

BACKGROUND OF THE INVENTION

The present invention relates to power tools, and more particularly, to tool housings for power tools.

Various pistol style power tools, including corded electric, cordless electric and pneumatic tools, are well-known. Examples of such tools include, but are not limited to, drills, drill drivers, impact wrenches, grease guns and the like. Such pistol style tools generally include a tool body defining a head portion with a handle depending therefrom. A trigger or the like is typically provided at the forward junction of the head portion and the handle. In an effort to make such tools lighter, the tool body is typically manufactured from plastic or the like formed in a clam shell manner in which opposed halves of the body are formed separately and then joined together. Such tools have been known to experience cracking, particularly when dropped, or alternatively, splitting along the clam shell seam.

It is desired to provide an improved pistol style and/or clam shell style tool housing.

SUMMARY OF THE INVENTION

The present invention provides in at least one aspect a pistol style tool housing. The tool housing includes a body defining a head portion with a handle portion depending therefrom to define a forward and/or a rear junction. A metal reinforcing member is configured to span along an inside surface of the body from the head portion to the handle portion such that the reinforcing member bridges either the forward or rear junction. In at least one embodiment, the reinforcing member is provided along each lateral side of the tool body.

In another aspect of the invention, the tool housing body is of a clam shell type, with two opposed body halves interconnected to define the tool housing body. At least one continuous reinforcing ring is positioned about both halves of the tool housing body to prevent splitting between the two halves. In at least one embodiment, the reinforcing ring is provided about a battery opening into the tool housing.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

Figure 1:
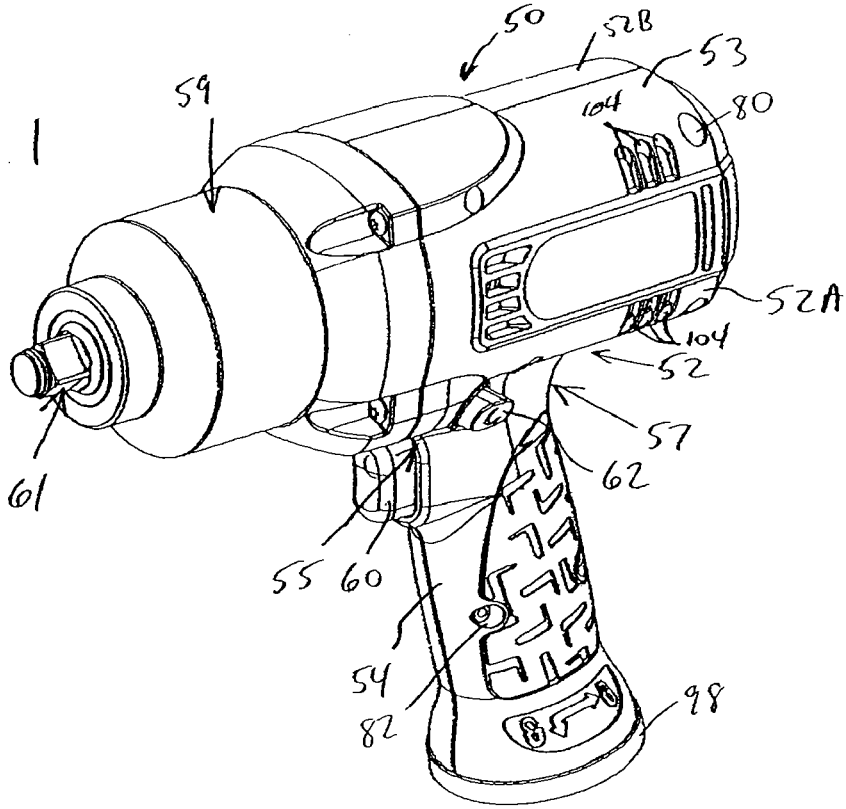
FIGS. 1-3 are isometric views of differently sized impact wrench tools incorporating one or more features of the present invention.
Figure 2:
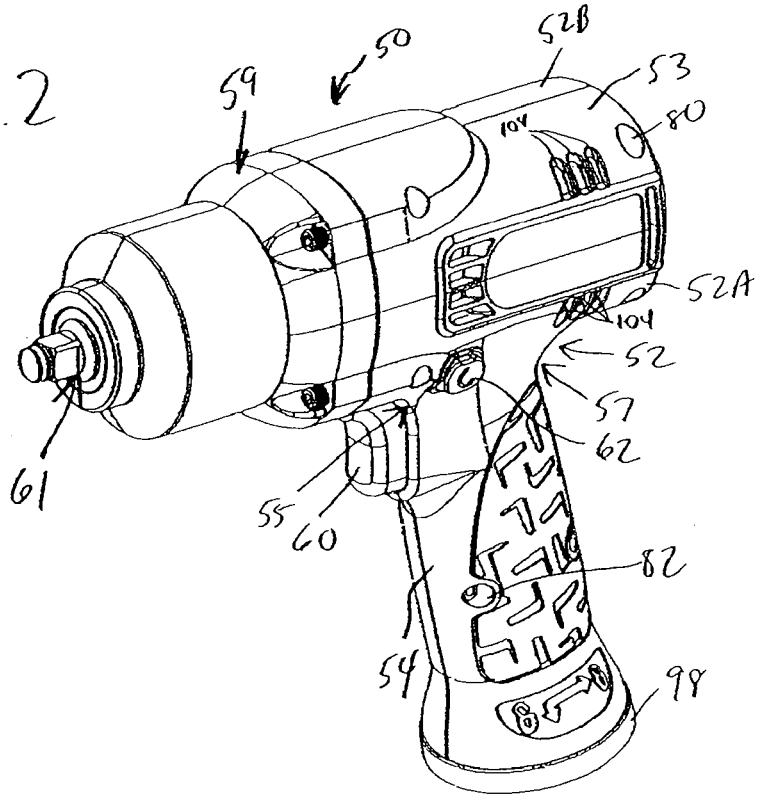
Figure 3:
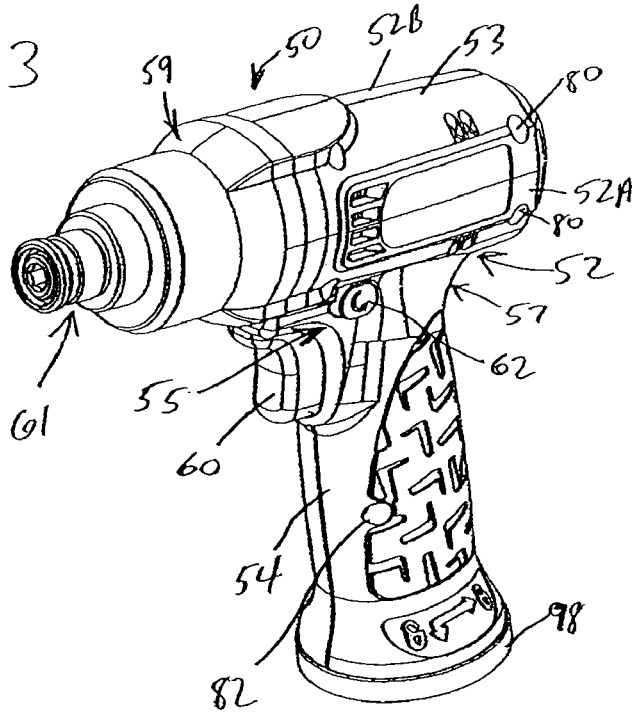
Figure 4:
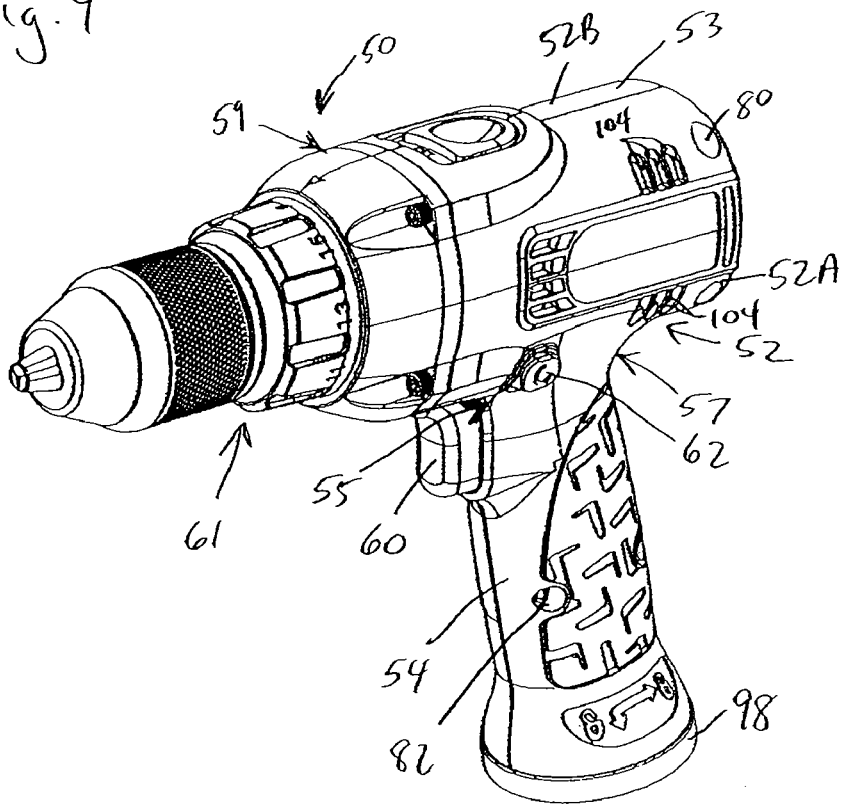
FIG. 4 is an isometric view of a drill tool incorporating one or more features of the present invention.
Figure 5:
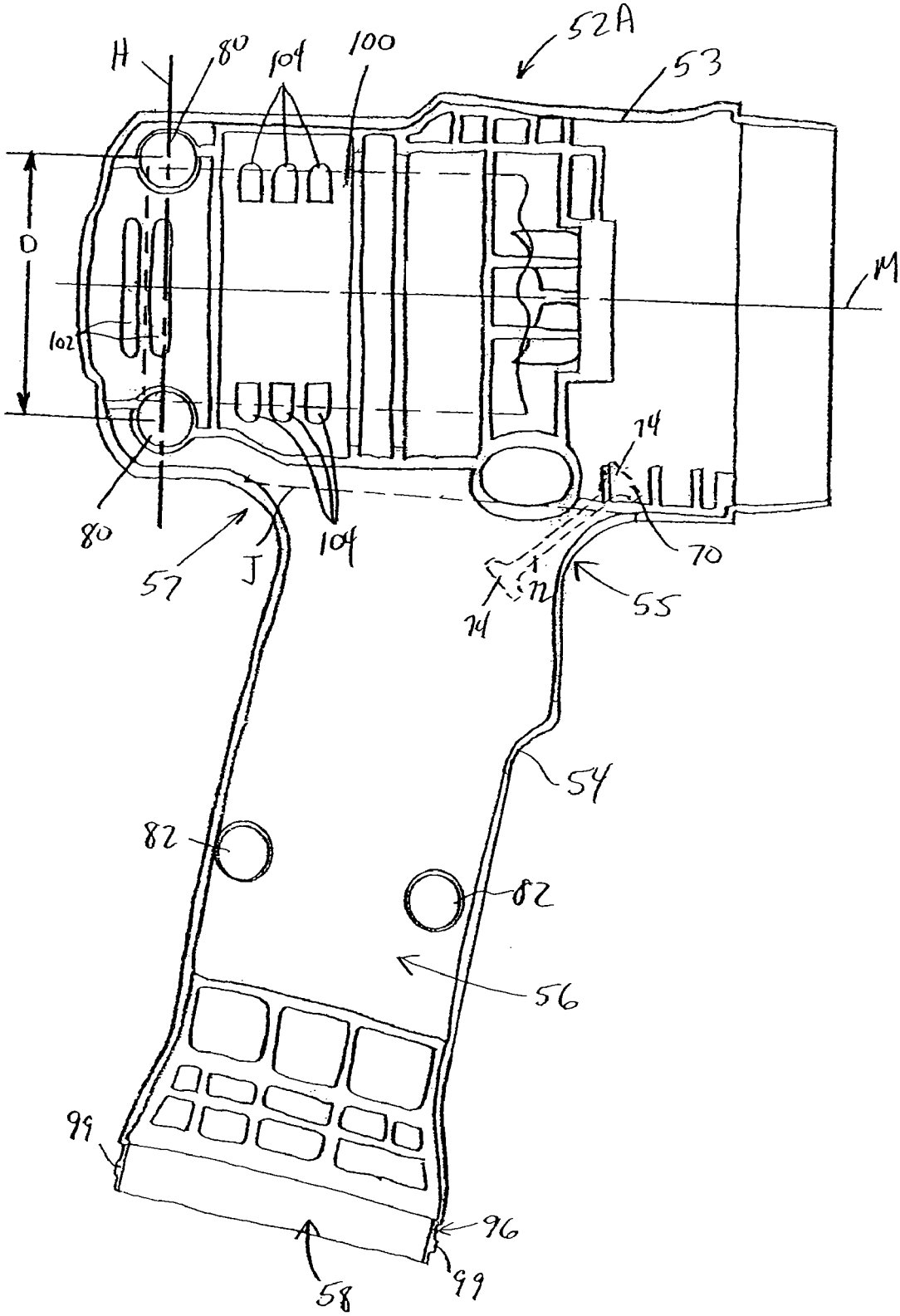
FIG. 5 is an elevation view illustrating the inside of one half of the clam shell housing.

Referring to FIGS. 1-4, various exemplary power tools 50 are illustrated. In FIGS. 1-3, the illustrated tools 50 are cordless impact wrenches and in FIG. 4, the illustrated tool 50 is a cordless drill, however, the present invention is not limited to such tools. For example, but not limited to, the tool 50 may be cordless or corded, pneumatic, or otherwise powered. Furthermore, the invention is not limited to drills and impact wrenches, but includes other power tools. Each of the illustrated tools 50 includes a tool body 52 defining a head portion 53 and a handle 54 depending therefrom. In each of the illustrated tools 50, a forward junction 55 and a rearward junction 57 is defined at the junction between the head portion 53 and the handle 54. Referring to FIG. 5, an imaginary plane J extends along the junction between the head portion 53 and the handle 54. In each of the illustrated tools 50, a trigger 60 is provided at the forward junction 55, however, such is not required. In each of the illustrated tools 50, a forward/reverse slide switch 62 is also provided adjacent the forward junction 55. Again, such is not required. Forward of the head portion 53 is a head cap 59. As illustrated in FIGS. 1-4, the head cap 59 can have various configurations. Furthermore, as illustrated in FIGS. 1-4, the tool head 61 can also have various configurations forward the head cap 59.

Referring to FIG. 5, the interior of a first half 52A of a tool housing body 52 is illustrated. In each of the illustrated embodiments, the handle 54 defines a generally hollow area 56 with an opening 58 into the hollow area 56. The opening 58 is configured to receive a battery pack (not shown). As set forth above, the present invention is not limited to cordless power tools. Furthermore, while the illustrated embodiments provide the hollow area 56 and the opening 58 within the handle 54 of the electric tool 50, the invention is not limited to such. If a hollow area 56 is provided, it may be provided at any desired location within the tool 50 with the opening 58 correspondingly positioned to open into the hollow area 56.

Figure 6:
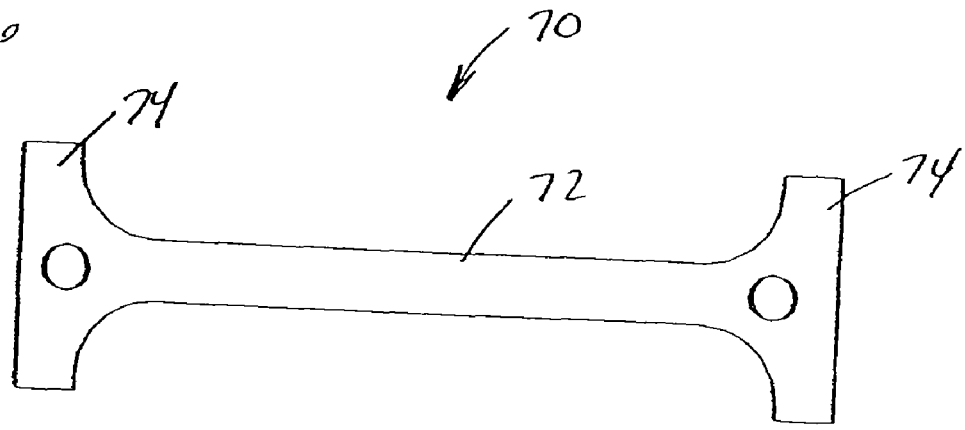
FIG. 6 is a plan view illustrating an embodiment of the reinforcing member in accordance with at least one aspect of the invention.
Figure 7:
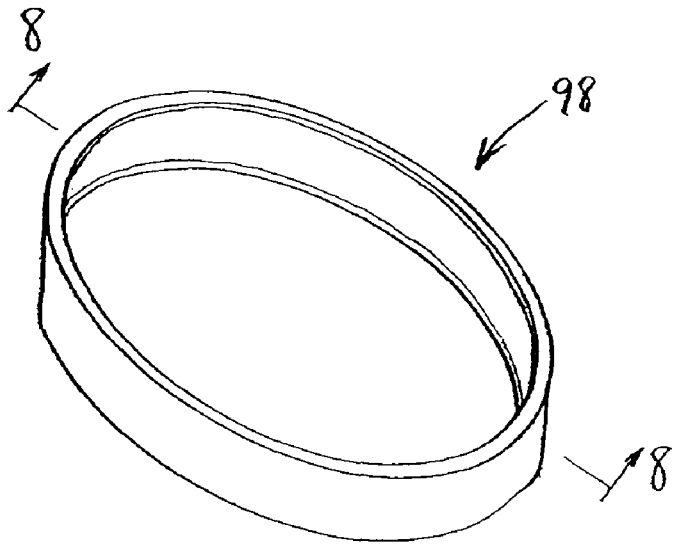
FIG. 7 is an isometric view illustrating an embodiment of the reinforcing ring in accordance with at least one aspect of the invention.

In the present embodiment, a reinforcing member 70 extends along the inside surface of the body 52 between the head portion 53 and the handle 54, bridging the imaginary plane J at the junction between the head portion 53 and the handle. The reinforcing member 70 is illustrated adjacent to the forward junction 55. The reinforcing member 70 may also be provided additionally, or alternatively, adjacent to the rearward junction 57. Referring to FIG. 6, the reinforcing member 70 of the present embodiment has a "dog bone" configuration, i.e. a narrow middle portion 72 with wider end portions 74. Such a configuration allows the middle portion 72 to be in tension while the ends 74 are in compression. Additionally, the wider end portions 74 may provide a greater area for connection to the housing body. As such, the reinforcing member 70 of the present embodiment is preferably positioned in high tensile regions of the tool housing 52. The reinforcing member 70 may have other configurations, for example, a consistent width along its length for regions in which tensile load is not as great.

The reinforcing member 70 is preferably manufactured from a metal, for example, steel, but may be manufactured from other materials having a higher tensile strength than the material of which the housing body 52 is manufactured, for example, composite materials or reinforced plastics. The reinforcing member 70 is preferably positioned in the mold of the housing body 52 and over molded during molding of the housing body 52, however, other methods may be utilized to interconnect the reinforcing member with the housing body 52. In clam shell type housings, the reinforcing member 70 is preferably provided in each half of the housing, i.e. a first reinforcing member 70 in one half of the clam shell housing and a second reinforcing member 70 in the other half of the clam shell housing but such is not required.

Referring again to FIGS. 1-4, each of the illustrated tools 50 is of the clam shell type. That is, the housing body 52 is made up of two opposed, interconnected halves 52A and 52B. The halves 52A and 52B are generally interconnected via screws or the like extending through various screw holes 80 and 82. While the screws or the like generally hold the halves 52A and 52B together, it is desirable to prevent inadvertent splitting between the halves 52A and 52B.

Figure 8:
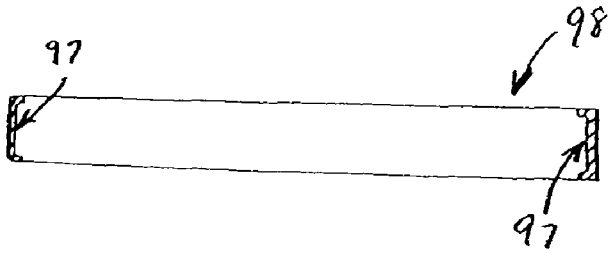
FIG. 8 is a cross-sectional view along the line 8-8 in FIG. 7.

Referring to FIGS. 1-4 and 7-8, a continuous reinforcing ring 98 is preferably provided about the tool housing 52 to maintain the halves 52A and 52B from splitting. Since the ring 98 is continuous, it is less susceptible to wear or loosening. In the illustrated embodiments, the ring 98 is provided adjacent to the opening 58. As illustrated in FIG. 5, the housing 52 may be provided with a circumferential channel 96 configured to receive the ring 98. As illustrated in FIG. 8, the ring 98 may include an internal channel 97 such that the ring 98 is snap fit over projections 99 extending from the housing 52 about the channel 96. While the reinforcing ring 98 is illustrated about the opening 58, it is not limited to such position. For example, the reinforcing ring may be positioned adjacent to the junction plane J, about the forward end of the head portion 53, the rearward end of the head portion 53 or any other location where radial forces may make such desirable. Additionally, while a pistol style housing is illustrated, the reinforcing ring may be used with tools having other configurations, for example, a linear tool body.

The reinforcing ring 98 is preferably manufactured from metal, but may be manufactured from other substantially rigid materials. The reinforcing ring 98 is preferably formed as a continuous member and snap fit or otherwise positioned about the housing 52. Alternatively, the reinforcing ring 98 may be formed with open ends which are attached, for example, via welding, after the ring 98 is positioned about the housing 58.

Referring to FIG. 5 another aspect of one or more embodiments of the present invention is illustrated. The screw holes 80 are positioned radially outwardly on the head portion 53. The holes 80 are positioned such that the center to center distance D is greater than an outer diameter of the motor housing 100 (shown in phantom). In such a configuration, the centerline H extending between the holes 80 may overlap a portion of the motor housing 100, thereby allowing the rear end of the housing body 52 to be shortened. Furthermore, it is preferable that the rear motor vents 102 extend circumferentially and are positioned such that the centerline H passes through at least one of the vents 102.

Referring to FIGS. 1-5, another aspect of one or more embodiments of the present invention is illustrated. The central motor vents 104 are positioned circumferentially outward relative to the motor housing centerline M such that the vents 104 are approximately tangential to the outer surface of the motor housing 100. As such, cooling flow about the motor housing 100 flows efficiently through the vents 104.

Referring to FIGS. 1-4, an aesthetic aspect of one or more embodiments of the present invention is illustrated. In a preferred aesthetic embodiment, both the head cap 59 and the reinforcing ring 98 are both the same color which is distinct from the color of the tool housing body 52. In a further aesthetic embodiment, the head cap 59, the forward/reverse slide switch 62 and the reinforcing ring 98 are all the same color which is distinct from the color of the tool housing body 52. In another aesthetic embodiment, the head cap 59 and the reinforcing ring 98 are both a chrome color while the tool housing body 52 is a dark contrasting color, for example, a charcoal grey. In another aesthetic embodiment, the head cap 59, the forward/reverse slide switch 62 and the reinforcing ring 98 are all a chrome color while the tool housing body 52 is a dark contrasting color, for example, a charcoal grey. The functional aspects of the present invention described above are not intended to be limited by the aesthetic features described herein.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A tool housing comprising:

a body with a head portion extending between a forward end and a rear end and a handle portion depending from the head portion between the forward and rear ends with the head portion and handle portion defining a continuous, uninterrupted inside surface that extends across a junction defined along a plane whereat the handle portion depends from the head portion; and a substantially rigid reinforcing member, having a planar structure with a major surface defining the length and width thereof and a minor surface defining the thickness thereof, the thickness being less than the width and length, positioned with the major surface extending along and parallel to the continuous, uninterrupted inside surface of the body from the head portion to the handle portion such that the reinforcing member bridges the junction at an angle oblique to the junction, wherein the reinforcing member has a dog bone configuration with a narrow middle portion between wider end portions such that the middle portion is in tension while the end portions are in compression.

2. The tool housing of claim 1 wherein the body includes opposed first and second body halves and the reinforcing member extends from the head portion to the handle portion along the inside surface of the first body half and a second reinforcing member extends from the head portion to the handle portion along the inside surface of the second body half.

3. The tool housing of claim 1 wherein the junction includes a forward junction area at the junction toward the forward end of the head portion and a rear junction area at the junction toward the rear end of the head portion, the forward junction area comprising a curved portion extending between the handle portion and the head portion and the reinforcing member is positioned adjacent to the forward junction area and tangential to the curved portion.

4. The tool housing of claim 3 wherein the tool housing is configured to receive a trigger proximate to the forward junction area.

5. The tool housing of claim 1 wherein the body is manufactured from a first material and the reinforcing member is manufactured from a second material having a higher tensile strength than the first material.

6. The tool housing of claim 5 wherein the second material is selected from the group consisting of metals, composite materials and reinforced plastics.

7. The tool housing of claim 1 wherein the reinforcing member is integrally molded with the body.

8. The tool housing according to claim 1 wherein the handle portion includes a channel formed at an outer surface of a lower portion thereof and at least one projection extending radially from the channel.

9. The tool housing of claim 1 wherein the junction includes a forward junction area at the junction toward the forward end of the head portion and a rear junction area at the junction toward the rear end of the head portion, the rear junction area comprising a curved portion extending between the handle portion and the head portion, and the at least one reinforcing member is positioned adjacent to the rear junction area.

10. The tool housing of claim 1 wherein the junction includes a forward junction area at the junction toward the forward end of the head portion and a rear junction area at the junction toward the rear end of the head portion, each of the forward junction area and the rear junction area comprising a respective curved portion extending between the handle portion and the head portion, the reinforcing member is at least a first reinforcing member positioned adjacent the forward junction area and tangential to its curved portion and a second reinforcing member positioned adjacent the rear junction area and tangential to its curved portion.

* * * * *

UNITED STATES PATENT AND TRADEMARK OFFICE

CERTIFICATE OF CORRECTION

PATENT NO. : 8,205,684 B2
APPLICATION NO. : 11/755260
DATED : June 26, 2012
INVENTOR(S) : Kokinelis et al.

It is certified that error appears in the above-identified patent and that said Letters Patent is hereby corrected as shown below:

At Column 5, line 11, delete “at least one”.

Signed and Sealed this
Twenty-fifth Day of September, 2012

David J. Kappos

David J. Kappos
*Director of the United States Patent and Trademark Office*